US006098747A

United States Patent [19]

Reece

[11] Patent Number: 6,098,747

[45] Date of Patent: Aug. 8, 2000

[54] RESCUE CHUTE

[76] Inventor: Norman Lee Reece, 940 Daphne, Broomfield, Colo. 80020

[21] Appl. No.: 09/291,574

[22] Filed: Apr. 8, 1999

[51] Int. Cl.[7] ..... A62B 1/20

[52] U.S. Cl. ..... 182/48; 182/70

[58] Field of Search ..... 182/48, 138, 70

[56] References Cited

U.S. PATENT DOCUMENTS

| | | | |
|---|---|---|---|
| 3,255,614 | 6/1966 | Kemmnitz . | |
| 3,348,630 | 10/1967 | Yamamoto | 182/48 |
| 4,005,762 | 2/1977 | Zephinie | 182/48 |
| 4,099,595 | 7/1978 | Tracy | 182/48 |
| 4,099,596 | 7/1978 | Tracy | 182/48 |
| 4,595,074 | 6/1986 | Norudfvedt | 182/48 |
| 4,681,186 | 7/1987 | Leisman et al. | 182/47 |
| 4,705,141 | 11/1987 | Splaine | 182/48 |
| 4,741,087 | 5/1988 | Plummer | 87/6 |
| 4,778,031 | 10/1988 | Curiel | 182/47 |
| 5,320,195 | 6/1994 | Reece | 182/48 |
| 5,433,991 | 7/1995 | Boyd . | |
| 5,806,624 | 9/1998 | Nordtvedt | 182/48 |
| 5,871,066 | 2/1999 | Reece | 182/48 |

*Primary Examiner*—Alvin Chin-Shue
*Attorney, Agent, or Firm*—H. Kenneth Johnston, II

[57] ABSTRACT

An escape device of the present invention for enabling people to escape and emergency personnel to remove injured people from burning or damaged buildings comprising a frame that has a normally folded flexible single chute securely affixed that is vertically extended for use consisting of a plurality of yarns knitted providing protection from heat and warp stability and weft expansion allows a controlled descent to the ground safely.

2 Claims, 4 Drawing Sheets

RESCUE CHUTE

BACKGROUND OF THE INVENTION

This invention relates to an improved apparatus for use in escaping from emergency situations and more specifically, it relates to an improved escape chute through which individuals and emergency personnel may remove injured people from burning or damaged buildings. Fires and other emergency situations require immediate action to safely evacuate the structure and minimize injury to individuals trying to escape from the structure. The problems with respect to such disasters have been more serious in multi-story structures as evacuation is much more difficult than that of a single story structure. Most multi-story homes have only a single stair case exit from the up stairs and those multi-story structures that have elevators are unable to use them in times of disasters.

There are known numerous devices for the emergency evacuation from buildings, sea vessels, and aircraft where emergency evacuation may be required in order to prevent death and prevent or minimize injuries resulting from disasters such as fires, explosions, earth quakes, crashes or other situations making it desirable for individuals to be safely and quickly evacuated.

U.S. Pat. Nos. 4,099,596, 4,099,595, and 3,348,630 disclose the use of chutes as escape devices. Disclosed are systems wherein the chutes contain discrete local braking elements which are adapted to retard the rate of descent of an individual employing the same. These disclosures also contain reference to a landing pad disposed at the bottom of the chute to facilitate the transition between generally vertically directed descent within the chute and discharge therefrom onto land. Theses local braking elements are a substantial detriment as an individual can have a relative fast rate of descent between the braking elements.

U.S. Pat. No. 4,778,031 discloses an escape device having outer and inner chutes, one for providing a heat shield and the other for providing controlled descent. The device is expensive and is not easily utilized and the capability of expanding to meet various sized individuals is limited to the expansion joint provides and does not provide a uniform expansion.

U.S. Pat. No. 3,973,644 discloses a chute system with a lowering device which is extremely complex and does not provide the flexibility that is necessary for a fast and high volume escape.

U.S. Pat. No. 5,320,195 discloses an escape chute having numerous Spandex strips to provide expansion joints for the controlled rate of descent which has similar disadvantages as does U.S. Pat. No. 4,778,031.

U.S. Pat. No. 4,681,186 has a double chute which is expensive and difficult to utilize.

One of the problems with the previous systems that were encountered was that because of the necessity of having a heat resistant material that a separate chute was necessary. The separate chute resulted in added weight and cost and reduced the ease of use.

On of the most important considerations in an emergency situation is to evacuate the premise quickly and safely and the previous art does not provide this quick and easy escape system which also allows the rescue of the disabled, injured or elderly individuals.

SUMMARY OF THE INVENTION

The present invention has met the need by providing a rescue device that allows easy use and does not rely on multiple chutes. The within invention is an improvement to U.S. Pat. No. 5,871,066. In the past chutes were made out of woven materials. The within device has improved qualities from the knit-weaving the chute. By combining the yarns of a fire and heat resistant material with a material that allows for some stretch, the improved chute is developed. As an unexpected result, the combining of these materials in the same fabric provides those properties that the double chutes were previously being required and yet the combined fabric provides superior results over the previous systems. It would not be expected that the combination of a fire or heat resistant material with a non heat or fire resistant material would give the unusual results that have been achieved.

The device is a single chute which is knit-weaved utilizing at least two different materials in the form of yarns, at least one yarn for providing a thermal barrier protecting the occupant from the heat generated in a fire situation and another providing the necessary elasticity so that individuals may enter the chute and stretch the chute horizontally allowing the slow descent through the chute. The thermal material may be a polyester such as Treveria FR or a polyamide such as Kevlar. The elastic material is a polyester such as Spandex which when knit with the fire retardant polyester or polyamide provides a continuous chute that an individual or rescue worker and injured person is supported and descends to safety as quickly or slowly as desired by the party.

The chute is made utilizing a knit-weave structure where the knit portion is in-the weft direction and the weave portion is in the warp direction. This knit portion utilizes the polyester elastic material and provides the stretch necessary when one is descending the chute and the weave portion utilizes the more ridged polyester and provides the fire and heat protection along with the tensile strength necessary to support individuals evacuating the structure.

As an additional safety precaution, the chute has support ribs added when the chute length exceeds several stories allowing the use of the chute when the structure is in excess of several stories. The support ribs are nylon or other web strapping approximately 2 inches in width and run the length of the chute and are affixed to the frame.

The chute can be deployed in minimum time and can be used for disabled, incapacitated and unconscious persons with the aid of at least one other healthy individual.

In the preferred embodiment, the chute is quickly deployed allowing the endangered individual to descend to safety.

It is an object of the present invention to provide an improved rescue chute that will facilitate more efficient and safe egress of individuals from a structure or other locations.

It is another object to provided such a rescue chute that is economical to manufacture, durable and easy to use even to those unskilled in the use of the equipment.

These and other objects of the invention will be more fully understood from the following description of the invention and reference to the illustrations appended hereto.

DETAILED DESCRIPTION OF THE PREFERRED EMBODIMENT

Figure 1:
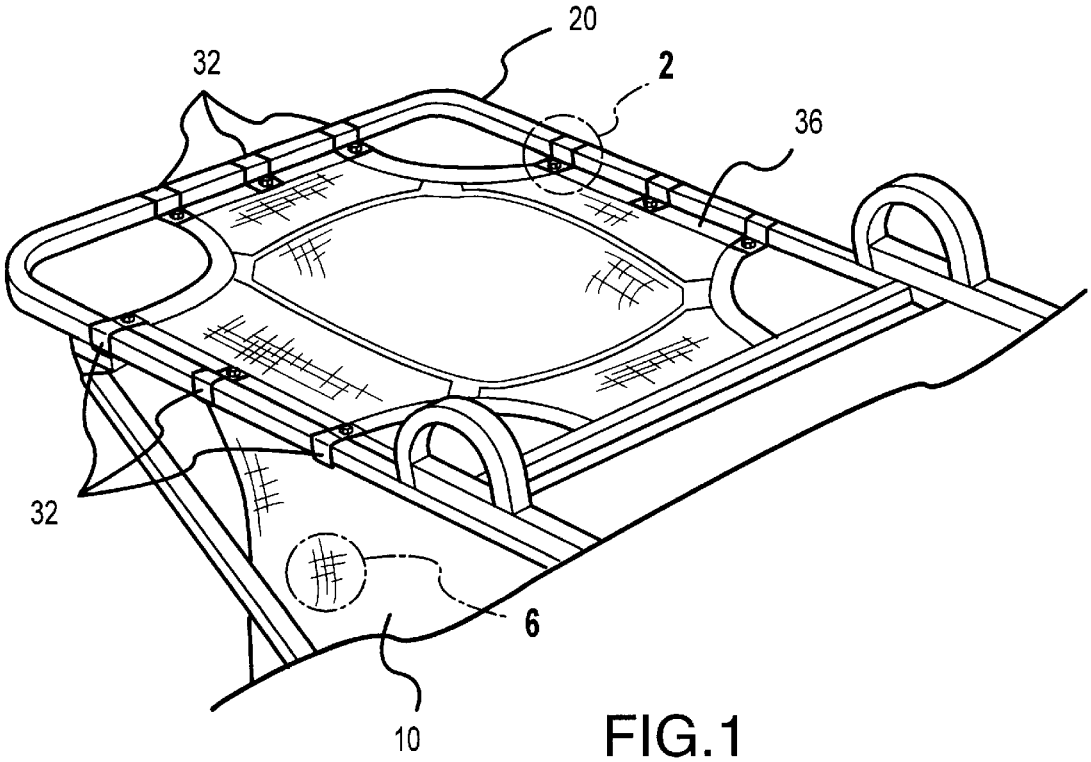
FIG. 1 is a perspective view of the chute attached to the frame.
Figure 2:
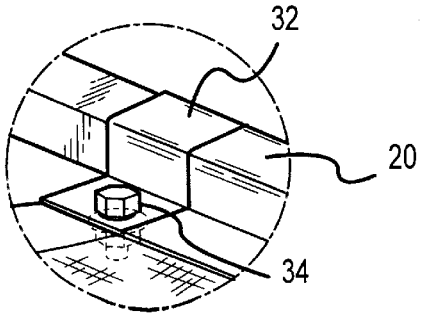
FIG. 2 is an enlarged illustration of the clamp portion.
Figure 3:
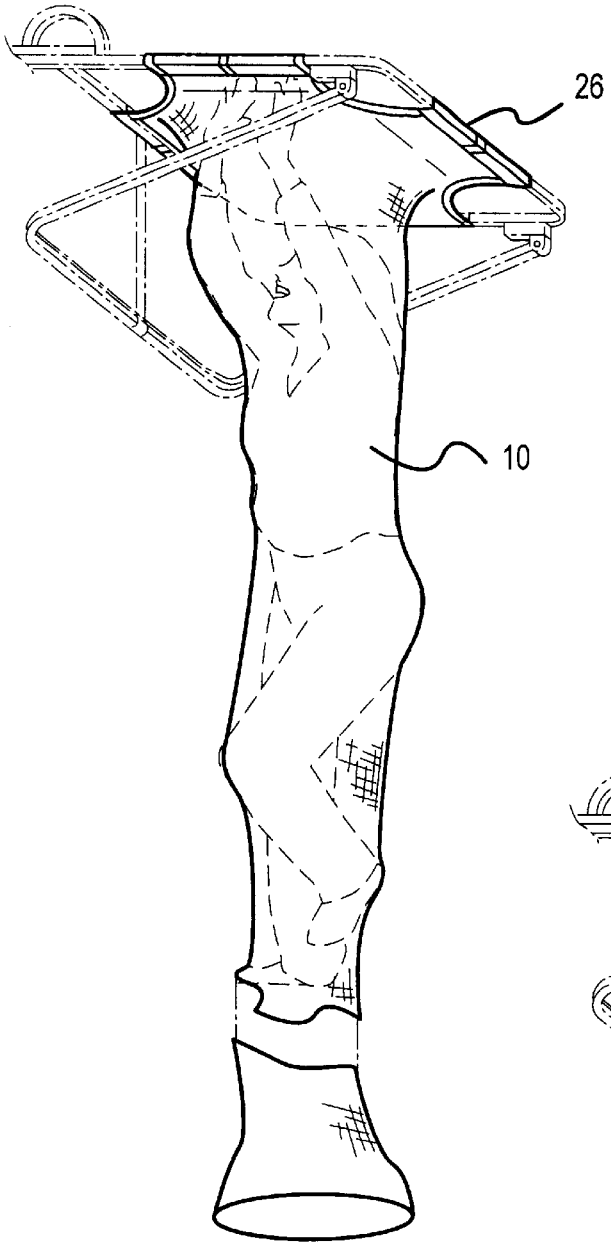
FIG. 3 is a perspective view of the chute in use.
Figure 4:
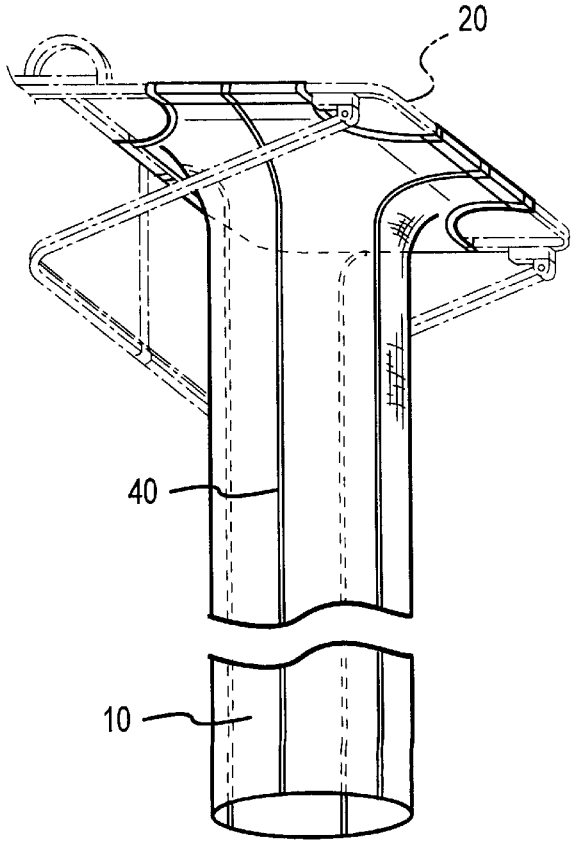
FIG. 4 is a perspective view of the chute in use.
Figure 5:
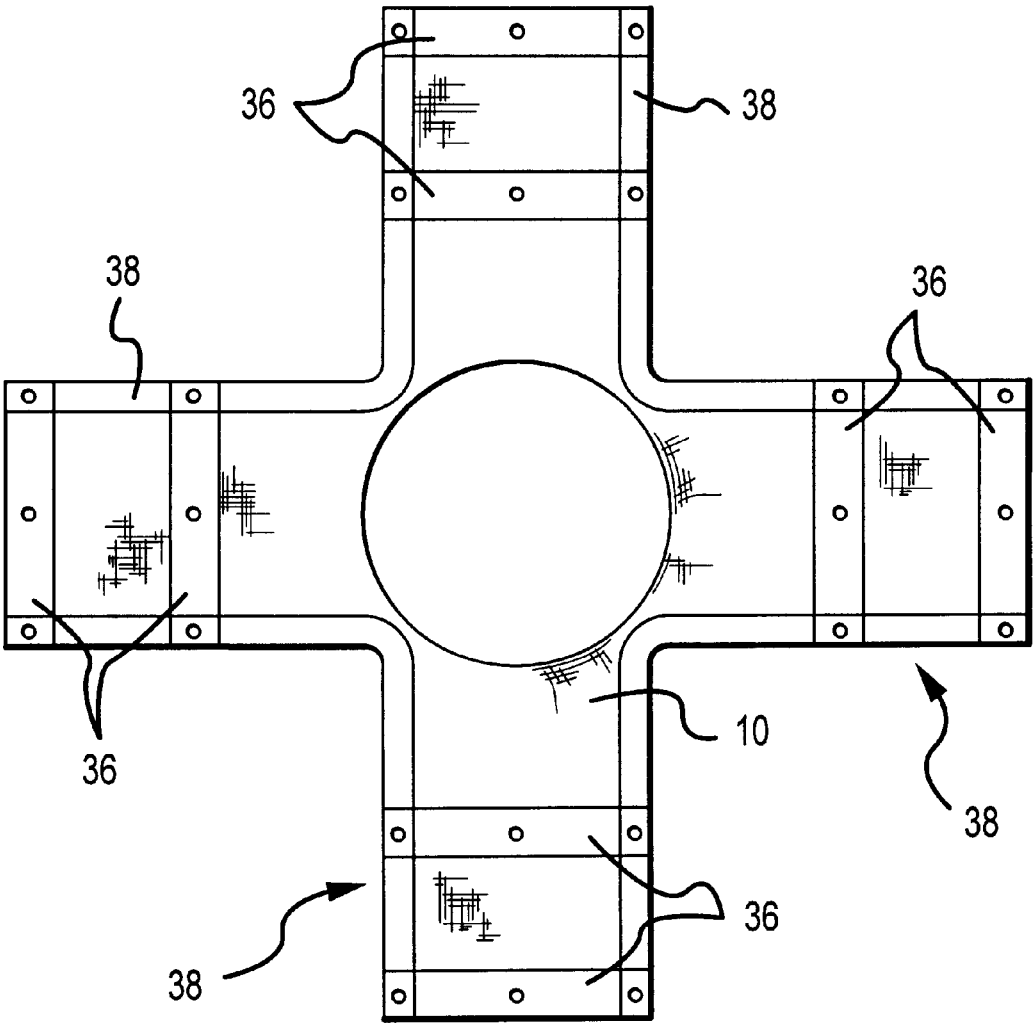
FIG. 5 is a top view of the chute ready for attachment to the frame.
Figure 6:
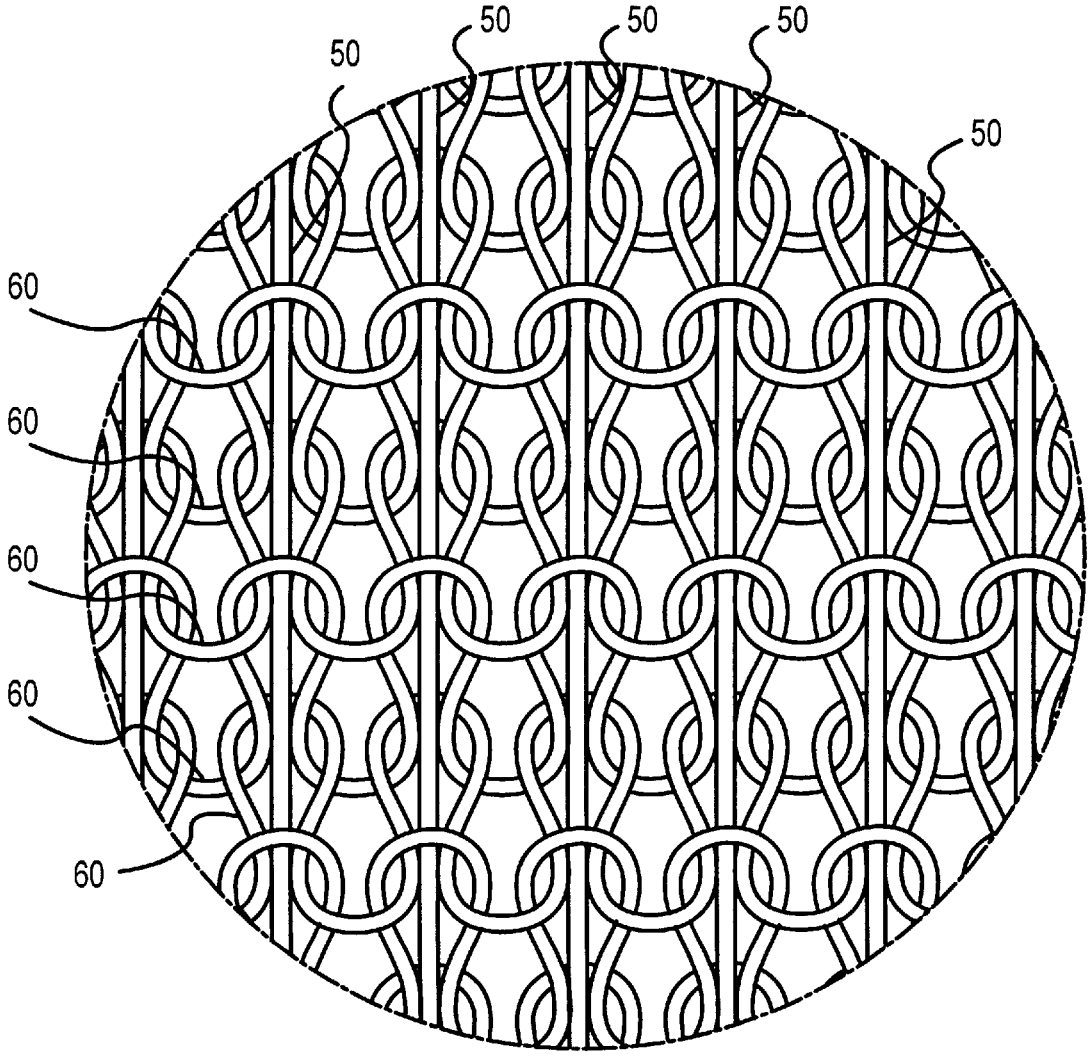
FIG. 6 is an enlarged illustration of the chute fabric taken in FIG. 1.

The chute 10 is prepared for attachment to frame 20 as shown in FIG. 5. Each flap 38 is folded over each corresponding section of frame 20 and affixed with a clamp 32 and fastener 34 as shown in FIG. 1. The chute 10 is affixed into place on the frame 20 with clamps 32 and fasteners 34 as shown in FIG. 2. In use the individual descends to safety by climbing into the escape chute and descending at the individuals own pace as shown in FIG. 3 and when structures exceed the height that the fabric alone can safely carry several individuals, a vertical support rib 40 is add to each quarter portion of the chute 10 providing the additional strength that is necessary when the height increases over several stories as shown in FIG. 4. It is necessary that the chute 10 has sufficient strength as well as elasticity to hold the weight of an individual and to stretch sufficiently to allow the individual to descend through the chute 10 to safety. The chute 10 fabric is constructed of two separate fiberous materials. The vertical fiber 50 providing fire retardancy and tensile strength and the horizontal fiber 60 providing the horizontal elasticity necessary for the chute 10 with the vertical fiber 50 being woven and the horizontal fiber 60 being knitted as shown in FIG. 6. Vertical fiber 50 maybe a polyester having the fire characteristics described such as Trevira FR a product of Hoechst Celanese or the vertical fiber 50 maybe a polyamide such as Kevlar a product of DuPont. The Kevlar is utilized as the vertical fibre for chute 10 where additional length is needed with out the use of the vertical support rib 40 the polyamide provides such strength.

It is understood that the certain variations in the invention may be made without departing from the scope thereof. Whereas particular embodiments of the invention have been described above for the purposes of illustration, it will be appreciated by those skilled in the art that numerous variation of the details may be made without departing from the invention as described in the appended claims.

What I claim:

1. An improved apparatus for use in escaping from emergency situations where an individual or individuals may be evacuated from a structure where the rate of descent is determined by said individual or individuals comprising:

a frame means;

said frame means being capable of supporting a vertically extending chute with individuals within said vertically extending chute;

said chute vertically extending securedly affixed to said frame means;

said vertically extending chute comprising a knit-woven fire retardant fabric having elastic properties in a weft direction and providing tensile strength in a warp direction of the fabric, and having a plurality of horizontally knit fibers and a plurality of vertically woven fibers whereby said horizontally knit fibers and said vertically woven fibers are different materials;

said horizontal fibers are knit and said vertical fibers are interwoven with said horizontal knit fibers and forming a cylindrical shape to be substantially smaller than the size of an average individual so that in an emergency situation said individual or individuals descend to safety by entering said chute and stretching said chute as said individual or individuals descend to the ground, wherein said horizontal knit fibers are elastic polyester fibers, and said vertical woven fibers are fire retardant polyamide fibers providing the tensile strength and fire retardant properties of the fabric.

2. An improved apparatus for use in escaping from emergency situations where an individual or individuals may be evacuated from a structure where the rate of descent is determined by said individual or individuals comprising:

a frame means;

said frame means being capable of supporting a vertically extending chute with individuals therein;

said vertically extending chute securedly affixed to said frame means;

a support rib means affixed to said frame means and said chute vertically extending for providing vertical support to said chute means;

said vertically extending chute comprising a knit-woven fire retardant fabric having elastic properties in a weft direction and providing tensile strength in a warp direction of the fabric, and having a plurality of horizontally knit fibers and a plurality of vertically woven fibers whereby said horizontally knit fibers and said vertically woven fibers are different materials;

said horizontally fibers are knit and said vertical fibers are interwoven with said horizontal knit fibers and forming a cylindrical shape to be substantially smaller than the size of a average individual so that in an emergency situation said individual or individuals descend to safety by entering said chute and stretching said chute as said individual or individuals descend to the ground, wherein said horizontal knit fibers are elastic polyester fibers, and said vertical woven fibers are fire retardant polyamide fibers providing the tensile strength and fire retardant properties of the fabric.

* * * * *